United States Patent [19]

Sanders

[11] 4,388,364

[45] Jun. 14, 1983

[54] HEAT SET WARP KNIT WEFT INSERTED FABRIC AND COATING THEREOF

[75] Inventor: Kenneth H. Sanders, Jonesville, S.C.

[73] Assignee: Milliken Research Corportion, Spartanburg, S.C.

[21] Appl. No.: 385,023

[22] Filed: Jun. 4, 1982

[51] Int. Cl.[3] ..... B32B 27/02; B32B 27/12; B32B 27/36

[52] U.S. Cl. ..... 428/253; 28/167; 66/195; 427/394; 428/254; 428/257; 428/265; 428/272; 428/287

[58] Field of Search ..... 428/254, 257, 265, 272, 428/287, 253; 28/167; 66/195; 427/394

[56] References Cited

U.S. PATENT DOCUMENTS 4,035,961 7/1977 Pemrick et al. ..... 51/295
4,304,813 12/1981 Elmore ..... 428/254

*Primary Examiner*—James C. Cannon
*Attorney, Agent, or Firm*—Earl R. Marden; H. William Petry

[57] ABSTRACT

A coated shelter type fabric using a substrate fabric of substantially all polyester yarns. The substrate fabric is a weft inserted knit fabric which has been heat stretch and set prior to the coating operation.

5 Claims, 5 Drawing Figures

HEAT SET WARP KNIT WEFT INSERTED FABRIC AND COATING THEREOF

This invention relates generally to a substrate fabric to be coated with a polymeric material with the edge curl and the elongation of the fabric controlled to provide a stable coated fabric.

Therefore, it is an object of the invention to provide a knit heat stretched and set, weft inserted, polyester fabric for the coating trade which is light weight, easily converted to desired configuration and durable in use.

Other objects and advantages of the invention will become readily apparent as the specification proceeds to describe the invention with reference to the accompanying drawings, in which.

Figure 1:
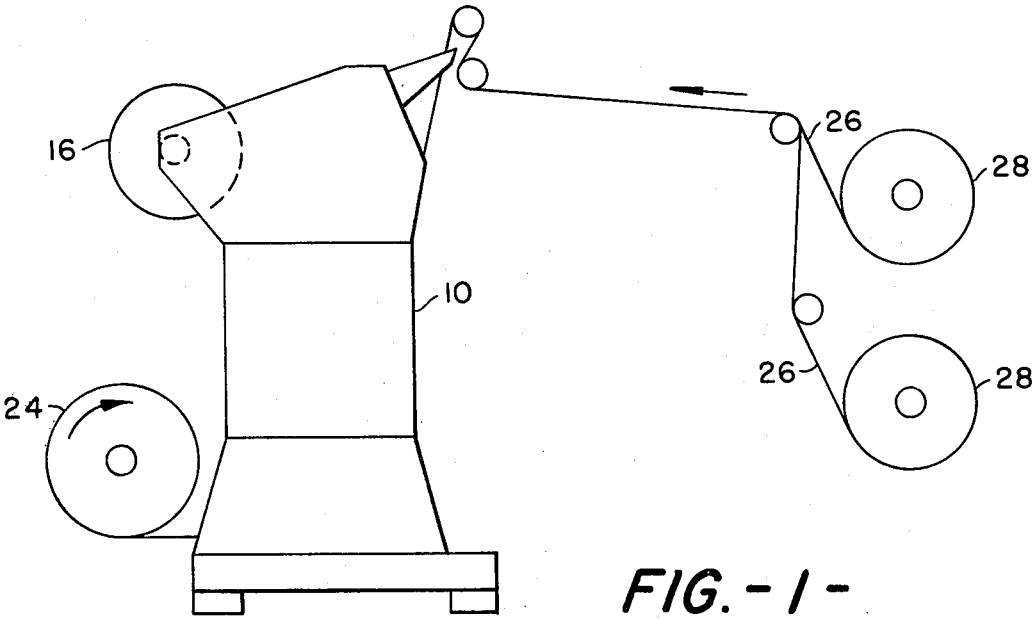
FIG. 1 is a side schematic view of the machine to produce the new substrate fabric.
Figure 2:
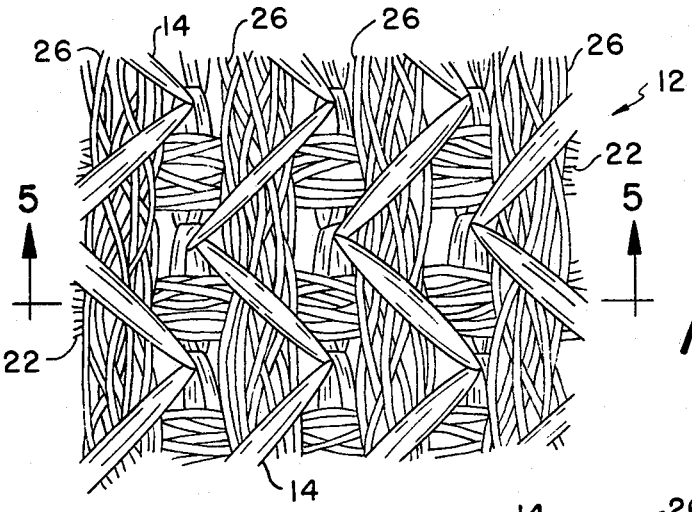
FIG. 2 is a top view of the substrate fabric produced on the machine of FIG. 1.
Figure 3:
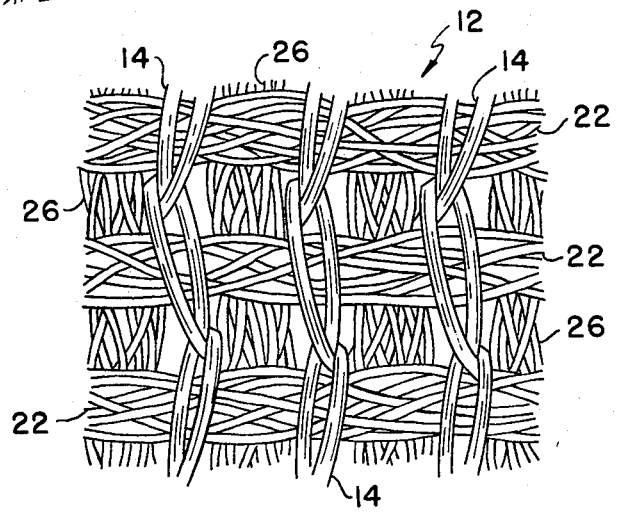
FIG. 3 is a bottom view of the fabric shown in FIG. 2.
Figure 5:
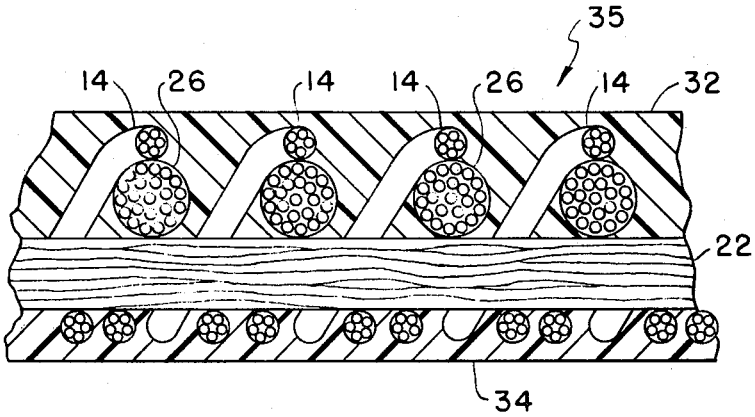
FIG. 5 is a cross-section taken on line 5—5 of FIG. 3 showing the top and bottom thereof coated with a desired material.

FIG. 1 schematically represents a warp knit, weft inserting knitting machine 10 which is employed to provide the substrate fabric 12 shown in FIGS. 2 and 3. In the preferred form of the invention, it is desired to produce a 100% polyester substrate fabric. To this end, the knitting yarn 14 supplied from the warp beam 16 through the guide bars of the machine 10 to the needles is a 70 denier, 34 filament DuPont type 56 polyester. The lay-in filling yarn 22 supplied from side mount creels (not shown) to a rotating screw type member is a 1,000 denier, 192 filament, DuPont type polyester yarn which extends across the wales of the fabric and the lay-in warp yarns 26 from the beams 28 are 840 denier, 192 filament, DuPont type 68, low elongation polyester extending across the courses of the fabric. The warp yarns 26 and the fill yarns 22 as the needles, guide bars and sinker of the warp knitting machine 10 co-act in conventional manner to knit the yarn 14 in a one-half tricot stitch to lock in the lay-in warp and fill yarns 26 and 22. As shown in FIGS. 2, 3 and 5, the knit yarn 14 secures the warp yarn 26 and the fill yarn 22 in position.

Figure 4:
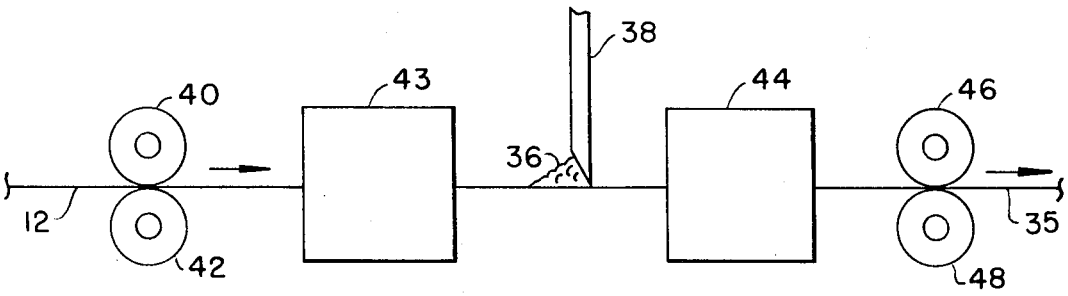
FIG. 4 is a schematic coating range for the novel substrate fabric.

After the fabric 12 has been formed by the knitting machine, it is taken-up on the roll 24 and transferred to a three-stage hot stretching machine 43 in a manner disclosed in U.S. Pat. No. 4,035,961, to relieve the tendency of the selvedge to curl and to eliminate undesired stretch and/or elongation. The fabric is placed under both widthwise and lengthwise tension as it passes through the hot stretch range at an average speed of 25 yds/min. at temperatures of 275° F. in the first stage, 400° F. in the second stage, and 425° F. in the third stage. Thereafter the tension is relaxed and the fabric will remain set or stabilized in its new configuration. Then, after completion of the hot stretching operation the fabric is delivered, either in-line as shown in FIG. 4, or off-line, to the coating range shown schematically in FIG. 4.

The polymeric coatings 32 and 34 can be applied in any suitable manner to produce a coated fabric 35 as illustrated in FIG. 5 wherein the polymeric material 36 is knife coated by knife 38 onto the substrate 12 delivered by the rolls 40 and 42. From the knife 38 the coated fabric will normally be delivered to a dryer 44 by rolls 46 and 48 and then delivered to a point of use. FIG. 4 illustrates a single pass unit and to obtain both the top and bottom coatings, the substrate will be run through twice with the uncoated side being face up on the second pass under the knife 38. FIG. 4 is only illustrative since other coating systems such as (1) roll over roll, or (2) knife over roll can be employed, if desired.

It can be seen that a polyester weft inserted, knit fabric has been provided that, when coated with a suitable polymeric material, provides a coated fabric which has high tensile strength, tear resistance, and dimensional stability. Dimensional stability includes resistance to raveling and widthwise distortion as well as elongation in the lengthwise direction.

Although the preferred embodiment of the invention has been described in detail, it is contemplated that changes may be made without departing from the scope or spirit of the invention and therefore, I desire to be limited only by the claims.

I claim:

1. A coated fabric comprising a layer of polymeric material coated onto one side of a heat stretched and set polyester warp knit fabric, said polyester warp knit fabric having a plurality of courses and wales of tricot stitches and a plurality of spaced weft yarns laid into said fabric and held therein by said tricot stitches.

2. The fabric of claim 1 wherein said polyester fabric further includes a plurality of warp yarns laid in the warp direction and held therein by said tricot stitches.

3. The fabric of claim 1 wherein said weft yarns ae laid in between the courses of tricot stitches of said fabric.

4. The fabric of claim 3 wherein both sides of said fabric are coated with a polymeric material.

5. A method of making a stabilized coated fabric comprising the steps of: warp knitting a weft inserted substrate fabric from substantially all polyester yarn, heat stretching and setting the polyester fabric after knitting, coating the polyester substrate fabric with a polymeric material and heating the polymeric material to fix the polymeric material to said polyester substrate fabric.

* * * * *